United States Patent [19]

Richardson, Jr. et al.

[11] Patent Number: 4,911,620

[45] Date of Patent: Mar. 27, 1990

[54] SCROLL COMPRESSOR TOP COVER PLATE

[75] Inventors: Hubert Richardson, Jr., Brooklyn; Thomas R. Barito, Tecumseh, both of Mich.

[73] Assignee: Tecumseh Products Company, Tecumseh, Mich.

[21] Appl. No.: 193,399

[22] Filed: May 12, 1988

[51] Int. Cl.[4] ..... F04C 18/04; F04C 29/06; F04B 39/14

[52] U.S. Cl. ..... 418/55; 418/181; 417/902

[58] Field of Search ..... 418/55, 181, 57; 417/312, 902; 29/156.4 R

[56] References Cited

U.S. PATENT DOCUMENTS

| | | | |
|---|---|---|---|
| Re. 19,893 | 3/1936 | Lipman | 62/204 |
| 1,967,035 | 7/1934 | Lipman | 417/902 |
| 2,130,349 | 9/1938 | Kucher . | |
| 2,517,145 | 8/1950 | Tiedje . | |
| 2,612,311 | 9/1952 | Warrick et al. . | |
| 2,670,894 | 3/1954 | Warrick et al. | 417/902 |
| 3,924,977 | 12/1975 | McCullough | 418/55 D |
| 4,411,604 | 10/1983 | Terauchi | 418/55 R |
| 4,560,330 | 12/1985 | Murayama et al. | 418/55 R |
| 4,609,334 | 9/1986 | Muir et al. | 418/55 D |
| 4,696,629 | 9/1987 | Shiibayashi et al. | 418/55 R |
| 4,767,293 | 8/1988 | Caillat et al. | 418/55 D |

*Primary Examiner*—John J. Vrablik

*Attorney, Agent, or Firm*—Albert L. Jeffers; John F. Hoffman; David L. Ahlersmeyer

[57] ABSTRACT

A scroll-type hermetic compressor is disclosed including a compressor mechanism having a fixed scroll member. The fixed scroll member includes a plate portion that is subject to forces causing deflection thereof. A housing cover plate is attached to the back surface of the fixed scroll member so as to define a discharge pressure chamber therebetween for exposing a partial area of the back surface to compressed refrigerant fluid. The discharge pressure chamber also serves as a discharge muffler. Also disclosed is a method of assembling a compressor wherein a compressor mechanism is mounted to a top cover plate before the top cover plate is attached to an open-ended shell to form a hermetically sealed housing. The compressor mechanism is suspended from the top cover plate and extends into the interior of the housing.

20 Claims, 5 Drawing Sheets

SCROLL COMPRESSOR TOP COVER PLATE

BACKGROUND OF THE INVENTION

The present invention relates generally to a hermetic scroll-type compressor and, more particularly, to such a compressor having intermeshing fixed and orbiting scroll members, wherein during compressor operation it is desirable to minimize deflection of the fixed and orbiting scroll members to promote proper sealing therebetween.

A typical scroll compressor comprises two facing scroll members, each having an involute wrap, wherein the respective wraps interfit to define a plurality of closed pockets. When one of the scroll member is orbited relative to the other, the pockets travel between a radially outer suction port and a radially inner discharge port to coney and compress the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant fluid at the interface between the scroll members tends to cause deflection, i.e., bowing out, of the scroll members away from the interface. This deflection of the scroll members causes the closed pockets to leak at the interface between the wrap tips of one scroll member and the face surface of the opposite scroll member. Such leakage results in reduced compressor operating efficiency. Furthermore, the stress associated with repeated cycles of deflection may cause weakening and premature failure of compressor components and assembly joints.

Whereas the orbiting scroll member is typically axially reinforced by a driven hub portion, the fixed scroll member includes a plate portion otherwise having no reinforced backing. Consequently, the fixed scroll member is more likely to experience deflection. In a common configuration of a hermetic scroll compressor, a chamber adjacent the back side of the fixed scroll member is defined by the entire back surface of the fixed scroll member plate portion and a housing end portion. If the chamber is occupied by refrigerant fluid at suction pressure, the resulting pressure differential between the chamber and the closed pockets causes outward deflection of the plate portion and its associated leakage. Alternatively, if the chamber is occupied by refrigerant fluid at discharge pressure, the resulting pressure differential causes inward deflection of the plate portion. Inward deflection results in grinding of the wrap tips and face surfaces, which causes friction losses and affects sealing characteristics under varying compressor operating conditions.

In order to prevent deflection of the fixed scroll member, the thickness of the plate portion can be increased and/or stronger materials can be used. However, such an approach to providing stiffness to and reducing deflection of the plate portion tends to increase the size, weight, and expense of the compressor.

Another disadvantage of hermetic scroll-type compressors of the type described herein is the difficulty encountered in assembling a scroll compressor mechanism within a housing. Specifically, the compressor mechanism is typically mounted within a cylindrical central housing portion prior to hermetically sealing the housing by the attachment of opposing housing end portions. This method of assembly requires setting of the air gap between the motor rotor and stator at the same time the compressor mechanism is mounted in the housing. Furthermore, this and other known methods of assembly are tedious and labor intensive, thereby adding to the overall cost and complexity of the scroll compressor.

The present invention is directed to overcoming the aforementioned problems associated with scroll-type compressors, wherein it is desired to minimize deflection of the plate portion of the fixed scroll member and provide an improved method of assembling a scroll compressor.

SUMMARY OF THE INVENTION

The present invention overcomes the disadvantages of the above-described prior art scroll-type compressors by providing a plate member for a hermetic scroll compressor, wherein the plate member is attached adjacent the back surface of the fixed scroll member to resist deflection thereof and promote easy assembly of the compressor.

Generally, the invention provides, in one form thereof, a scroll-type compressor comprising fixed and orbiting scroll members, wherein the fixed scroll member has a plate portion that is subject to deflection caused by compressed refrigerant fluid at the interface between the fixed and orbiting scroll members. In one aspect of the invention, a predetermined partial area of the back surface of the fixed scroll member plate portion is exposed to refrigerant fluid at discharge pressure to substantially equalize the forces acting on the plate portion, thereby substantially eliminating deflection thereof.

More specifically, the invention provides, in one form thereof, a scroll compressor including fixed and orbiting scroll members intermeshed to define pockets of compressed refrigerant fluid. The fixed scroll member comprises a plate portion subject to deflection due to compression forces produced in the pockets. In accordance with one aspect of the invention, a reinforcement plate is attached adjacent the back surface of the fixed scroll member plate portion to define a discharge chamber therebetween, into which compressed refrigerant is discharged, thereby exposing a partial area of the back surface to discharge pressure to substantially eliminate deflection of the fixed scroll member. In accordance with another form of the invention, wherein the scroll compressor includes a hermetic housing, the reinforcement plate comprises a top cover plate for a housing shell having a top opening. The cover plate covers the top opening and is sealingly attached to the housing shell. A scroll compressor mechanism is suspended from the cover plate and extends within the housing interior.

An advantage of the scroll compressor of the present invention is that deflection of the fixed scroll member is substantially eliminated, thereby allowing better control of scroll wrap tip clearances at compressor operating conditions.

Another advantage of the scroll compressor of the present invention is that the fixed scroll member plate portion can be made thinner so as to reduce material requirements and weight of the compressor.

A further advantage of the scroll compressor of the present invention is that the physical dimensions of the compressor are reduced.

Another advantage of the scroll compressor of the present invention is the provision of a top cover plate for hermetically sealed housing that substantially eliminates deflection of the fixed scroll member.

A further advantage of the scroll compressor of the present invention is that the top cover plate provides a discharge muffler.

Yet another advantage of the scroll compressor of the present invention is that the top cover plate provides a suction inlet isolated from discharge pressure and the heat associated therewith, thereby improving compressor efficiency.

A still further advantage of the scroll compressor of the present invention is that the top cover plate permits easy assembly of the compressor.

The scroll compressor of the present invention, in one form thereof, provides a fixed scroll member including a plate portion having a face surface and a back surface. The face surface has an involute fixed wrap element thereon. An orbiting scroll member is also provided including an involute orbiting wrap element. The fixed and orbiting wrap elements are intermeshed to define at least one pocket of refrigerant fluid compressed by orbiting motion of the orbiting scroll member with respect to the fixed scroll member. A plate is attached to the fixed scroll member adjacent the back surface thereof. The plate allows a predetermined partial area of the back surface to be exposed to compressed refrigerant fluid.

The invention further provides, in one form thereof, a scroll compressor including a fixed scroll member, an orbiting scroll member, and a plate member. The fixed scroll member includes a plate portion having a face surface-and a-back surface. The face surface has an involute fixed wrap element thereon. The plate portion includes a discharge port extending therethrough to provide fluid communication between a radially inner portion of the fixed wrap element and the back surface. The orbiting scroll member includes an involute orbiting wrap element, whereby the fixed and orbiting wrap elements are intermeshed to define at least one pocket of refrigerant fluid compressed radially inwardly toward the discharge port by orbiting motion of the orbiting scroll member with respect to the fixed scroll member. The plate member is attached adjacent the back surface of the fixed scroll member, A discharge chamber is defined by the plate member and a predetermined area of the back surface of the fixed scroll member. The discharge chamber is in fluid communication with the discharge port, whereby the partial area of the back surface is exposed to compressed refrigerant fluid.

The present invention further provides, in one form thereof, a hermetically sealed scroll compressor for compressing refrigerant fluid including a vertically upstanding shell having a top opening. A top cover plate is provided which covers the top opening and is sealingly attached thereto such that the shell and the cover plate comprise a hermetically sealed housing having an interior space. A scroll compressor mechanism is provided having a fixed scroll member, an orbiting scroll member, and a drive for causing the orbiting scroll member to orbit with respect to the fixed scroll member to compress refrigerant fluid. The compressor mechanism is attached to the top cover plate and extends downwardly into the interior space of the sealed housing.

The present invention still further provides, in one form thereof, a method of assembling a scroll compressor apparatus, wherein the apparatus includes a scroll compressor mechanism within a hermetically sealed housing. The compressor mechanism comprises a fixed scroll member having a plate portion. The method of assembly includes the steps of providing a top cover plate and mounting the compressor mechanism to the top cover plate such that the plate portion of the fixed scroll member is adjacent the top cover plate. A vertically upstanding shell is provided having a top opening. The method of assembly further provides the step of attaching the cover plate to the shell such that the cover plate sealingly covers the top opening and the compressor mechanism extends downwardly into the shell.

DESCRIPTION OF THE PREFERRED EMBODIMENT

Figure 1:
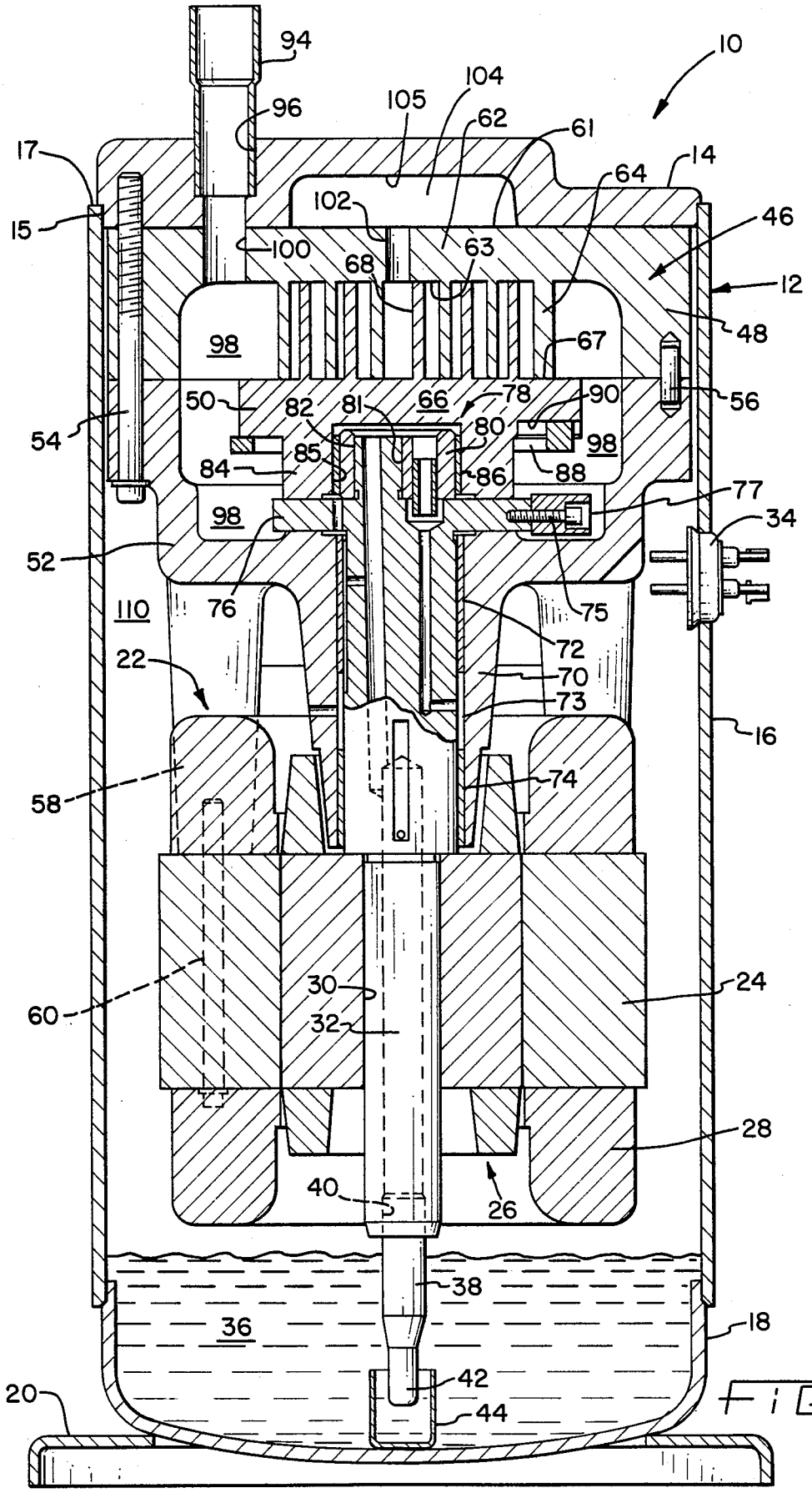
FIG. 1 is a longitudinal sectional view of a compressor of the type to which the present invention pertains, taken along the line 1—1 in FIG. 3 and viewed in the direction of the arrows.
Figure 2:
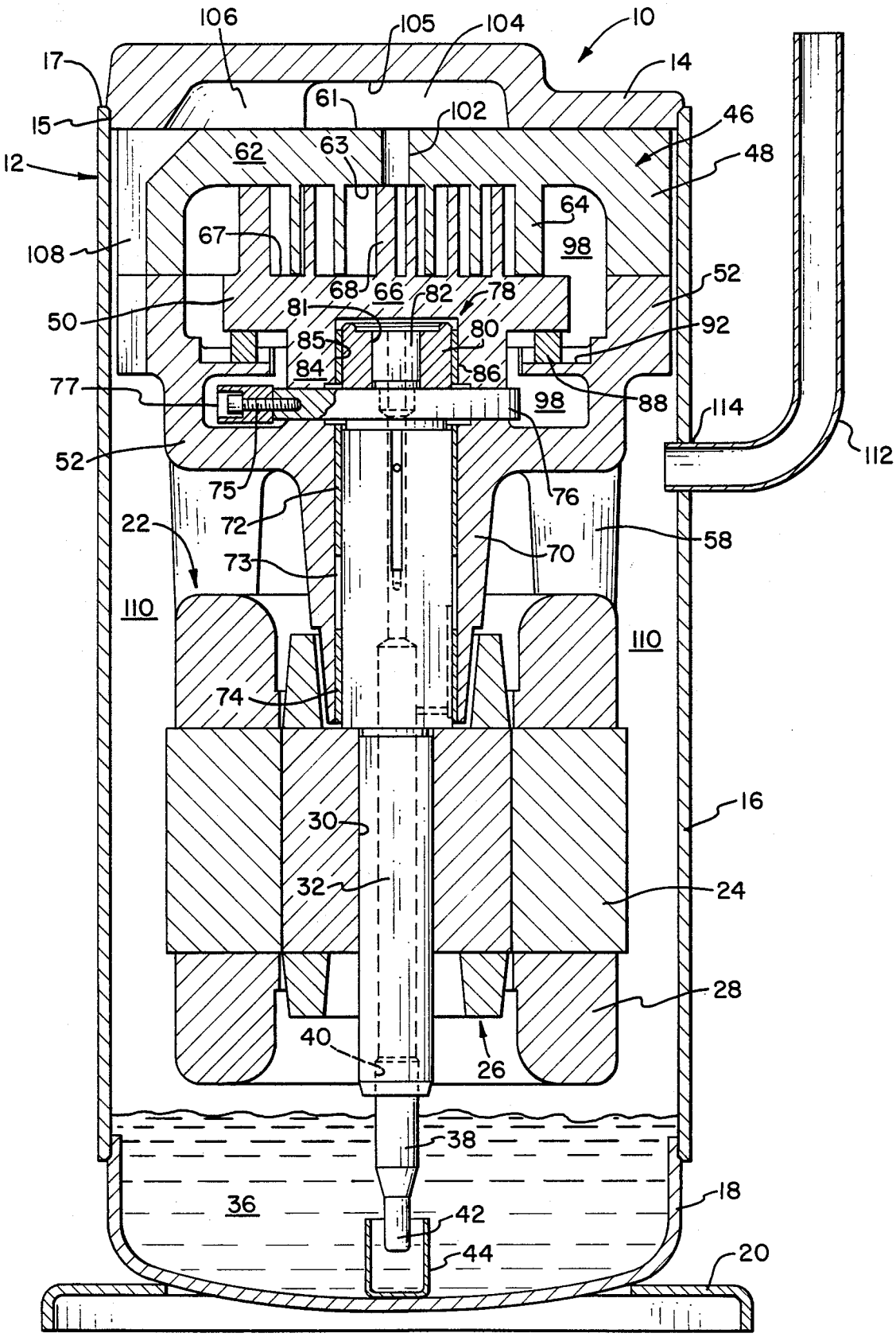
FIG. 2 is a longitudinal sectional view of the compressor of FIG. 1, taken along the line 2—2 in FIG. 3 and viewed in the direction of the arrows.
Figure 3:
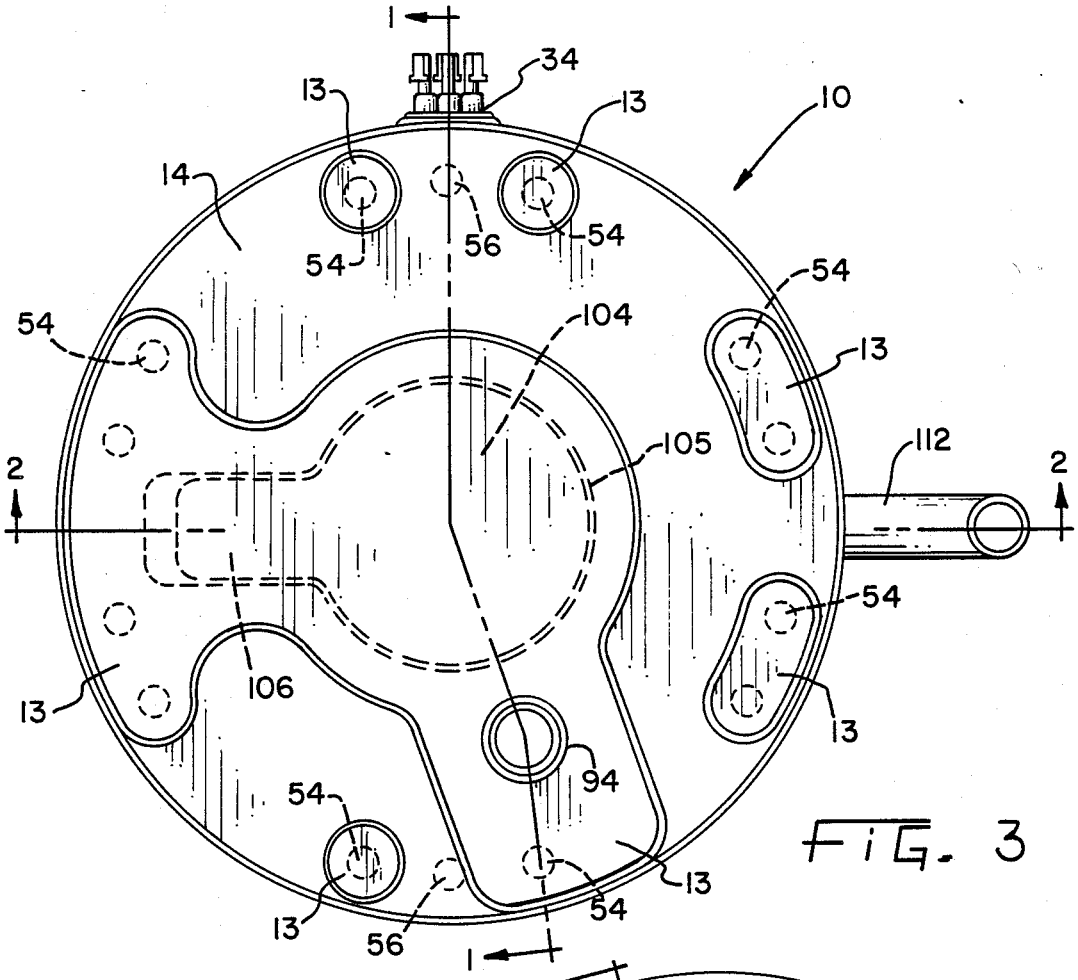
FIG. 3 is an enlarged top view of the compressor of FIG. 1.

In an exemplary embodiment of the invention as shown in the drawings, and in particular by referring to FIGS. 1-3, a compressor 10 is shown having a housing generally designated at 12. The housing has a top cover plate 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the comdpressor in a vertically upright position. Located within hermetically sealed housing 12 is an electric motor generally designated at 22, having a stator 24 and a rotor 26. Stator 24 is provided with windings 28. Rotor 26 has a central aperture 30 provided therein into which is secured a crankshaft 32 by an interference fit. A terminal cluster 34 is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of a cylindrical oil cup 44, which provides a quiet zone from which high quality, non-agitated oil is drawn.

Compressor 10 includes a scroll compressor mechanism 46 enclosed within housing 12. Compressor mechanism 46 generally comprises a fixed scroll member 48, an orbiting scroll member 50, and a main bearing frame member 52. As shown in FIG. 1, fixed scroll member 48 and frame member 52 are secured together and are attached to top cover plate 14 by means of a plurality of mounting bolts 54. Precise alignment between fixed scroll member 48 and frame member 52 is accomplished by a pair of locating pins 56. Frame member 52 includes a plurality of mounting pads 58 to which motor stator 34 is attached by means of a plurality of mounting bolts 60, such that there is an annular gap between stator 24 and rotor 26.

Fixed scroll member 48 comprises a generally flat face plate 62 having a back surface 61, a face surface 63, and an involute fixed wrap 64 extending axially from surface 63. Likewise, orbiting scroll member 50 comprises a generally flat face plate 66 having a top face surface 67, and an involute orbiting wrap 68 extending axially from surface 67. Fixed scroll member 48 and orbiting scroll member 50 are assembled together so that fixed wrap 64 and orbiting wrap 68 operatively interfit with each other. Furthermore, face surfaces 63, 67 and wraps 64, 68 are manufactured or machined such that, during compressor operation when the fixed and orbiting scroll members are forced axially toward one another, the tips of wraps 64, 68 sealingly engage with respective opposite face surfaces 67, 63.

Main bearing frame member 52, as shown in FIGS. 1 and 2, comprises a downwardly extending bearing portion 70. Retained within bearing portion 70, as by press fitting, is a conventional sleeve bearing assembly comprising an upper bearing 72 and a lower bearing 74. Two sleeve bearings are preferred rather than a single longer sleeve bearing to facilitate easy assembly into bearing portion 70 and to provide an annular space 73 between the two bearings 72, 74. Accordingly, crankshaft 32 is rotatably journalled within bearings 72, 74.

Crankshaft 32 includes a concentric thrust plate 76 extending radially outwardly from the sidewall of crankshaft 32. A balance weight 77 is atached to thrust plate 76, as by bolts 75. Situated on the top of crankshaft 32 is an eccentric crank mechanism 78. According to a preferred embodiment, crank mechanism 78 comprises a cylindrical roller 80 having an axial bore 81 extending therethrough at an off-center location. An eccentric crankpin 82, constituting the upper, offset portion of crankshaft 32, is received within bore 81, whereby roller 80 is eccentrically journalled about eccentric crankpin 82. Orbiting scroll member 50 includes a lower hub portion 84 that defines a cylindrical well 85 into which roller 80 is received. Roller 80 is journalled for rotation within well 85 by means of a sleeve bearing 86, which is press fit into well 85. Each of sleeve bearings 72, 74, and 86 is preferably a steel-backed bronze bushing.

When crankshaft 32 is rotated by motor 22, the operation of eccentric crankpin 82 and roller 80 within well 85 causes orbiting scroll member 50 to orbit with respect to fixed scroll member 48. Roller 82 pivots slightly about crankpin 80 so that crank mechanism 78 functions as a conventional swing-link radial compliance mechanism to promote sealing engagement between fixed wrap 64 and orbiting wrap 68. Orbiting scroll member 50 is prevented from rotating about its own axis by means of a conventional Oldham ring assembly, comprising an Oldham ring 88, and Oldham key pairs 90, 92 associated with orbiting scroll member 50 and frame member 52, respectively.

In operation of compressor 10 of the preferred embodiment, refrigerant fluid at suction pressure is introduced through suction pipe 94, which is received within a counterbore 96 in top cover plate 14 and is attached thereto as by silver soldering or brazing. A suction pressure chamber 98 is generally defined by fixed scroll member 48 and frame member 52. Refrigerant fluid is introduced into chamber 98 from suction tube 94 through a suction passageway 100 defined by aligned holes in top cover plate 14 and fixed scroll member 48. As orbiting scroll member 50 is caused to orbit, refrigerant fluid within suction pressure chamber 98 is compressed radially inwardly by moving closed pockets defined by fixed wrap 64 and orbiting wrap 68.

Refrigerant fluid at discharge pressure in the innermost pocket between the wraps is discharged upwardly through a discharge port 102 communicating through face plate 62 of fixed scroll member 48. Compressed refrigerant discharged through port 102 enters a discharge plenum chamber 104 defined by a partial area of back surface 61 and a centrally located circular recess 105 on the underside of top cover plate 14. A radially extending duct 106 formed in top cover plate 14 and an axially extending duct 108 extending along the side of fixed scroll member 48 and frame member 52 allow the compressed refrigerant in discharge plenum chamber 104 to be introduced into housing chamber 110 defined within housing 12. As shown in FIG. 2, a discharge tube 112 extends through central portion 16 of housing 12 and is sealed thereat as by silver solder 114. Discharge tube 112 allows pressurized refrigerant within housing chamber 110 to be delivered to the refrigeration system (not shown) in which compressor 10 is incorporated.

Deflection of face plate 62 that would ordinarily occur as the result of a pressure differential between face surface 63 and back surface 61 is substantially eliminated by the provision of discharge plenum chamber 104, whereby a partial area of back surface 61 is exposed to refrigerant fluid at discharge pressure. More specifically, circular recess 105 in cover plate 14 is sized such that a predetermined load distribution is established on back surface 61, concentrated primarily in the center. Accordingly, the resulting uniformly distributed downward force on face plate 62 substantially equals the radially inwardly increasing, upward force gradient produced by the compression pockets, thereby producing a net pressure differential across plate 62 of approximately zero at compressor rating point conditions, i.e. intended optimal compressor operating condition.

As best illustrated in FIGS. 1 and 2, top cover plate 14 of housing 12 also functions to mount scroll compressor mechanism 46 within housing chamber 110, such that no other direct contact is required between the compressor mechanism and the housing. As previously described, bolts 54 attach frame member 52 and fixed scroll member 48 to top cover plate 14. Cover plate 14 includes a peripheral lip 15 that engages the top annular edge 17 of central portion 16 to cover the top opening defined by annular edge 17. Cover plate 14 is welded or otherwise sealingly attached to central portion 16 to hermetically seal housing 12. Once cover plate 14 is attached to central portion 16 to form housing 12, compressor mechanism 46 is suspended and extends downwardly into housing chamber 110, and no mounting bolt heads are visible or accessible from the exterior of the housing.

It will be appreciated that cover plate 14, as described with respect to the preferred embodiment, exhibits several further advantages. Specifically, cover plate 14 acts as a heat sink for refrigerant fluid at suction pressure entering suction tube 94 and proceeding through suction passageway 100. In this manner, the incoming refrigerant fluid experiences cooling to improve the volumetric efficiency of the compressor. Furthermore, cover plate 14, as a component of housing 12, may experience deflection without adversely affecting its ability to prevent deflection of face plate 62. However, deflection of cover plate 14 may cause leakage from suction passageway 100 to discharge chamber 104 at the planar interface between abutting portions of cover plate 14 and fixed scroll member 48. To prevent such leakage, gaskets (not shown) may be placed within the planar interface circumjacent passageway 100 and/or around the periphery of chamber 104 and duct 106. Such gaskets would also help control the area of back surface 61 being exposed to discharge pressure.

Figure 4:
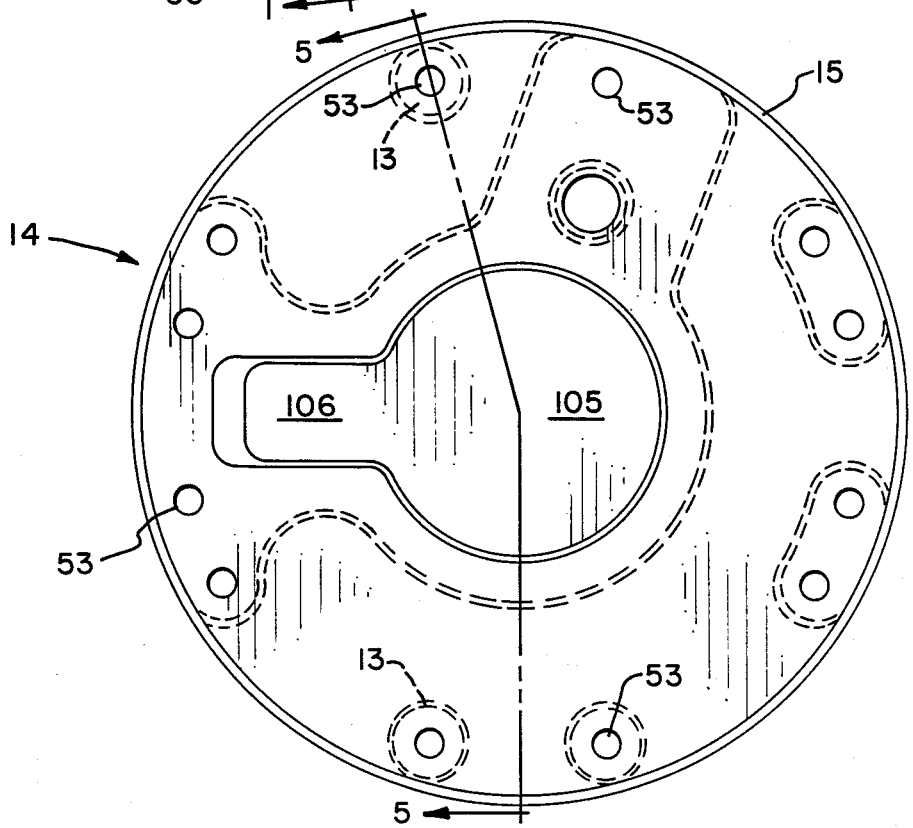
FIG. 4 is an enlarged bottom view of the top cover plate of the compressor of FIG. 1.
Figure 5:
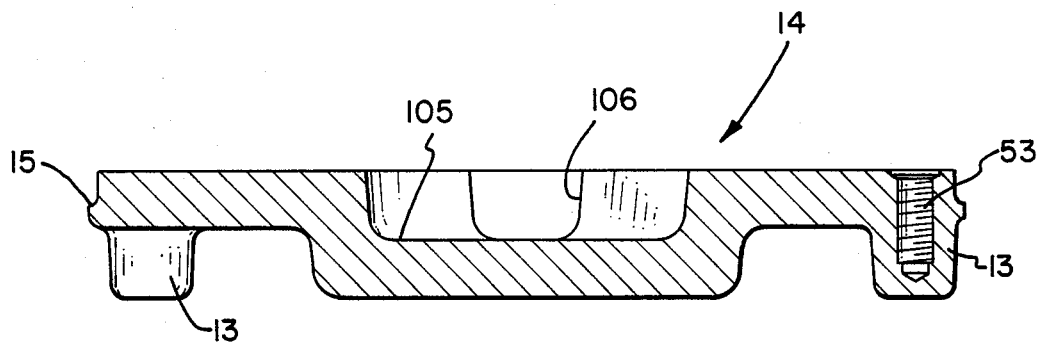
FIG. 5 is a longitudinal sectional view of the top cover plate of the compressor of FIG. 1, taken along the line 5—5 in FIG. 4 and viewed in the direction of the arrows.

Referring now to FIGS. 3–5 for a further detailed description of cover plate 14, a plurality of plate portions 13 having increased axial thickness are provided therein. Each portion 13 includes at least one tapped bore 53 for receiving the threaded ends of mounting bolts 54. Tapped bores 53 are shown as not extending to the outside surface of cover plate 14, thereby preventing any possible leakage path from the high pressure housing chamber 110 to the outside of the housing.

Figure 7:
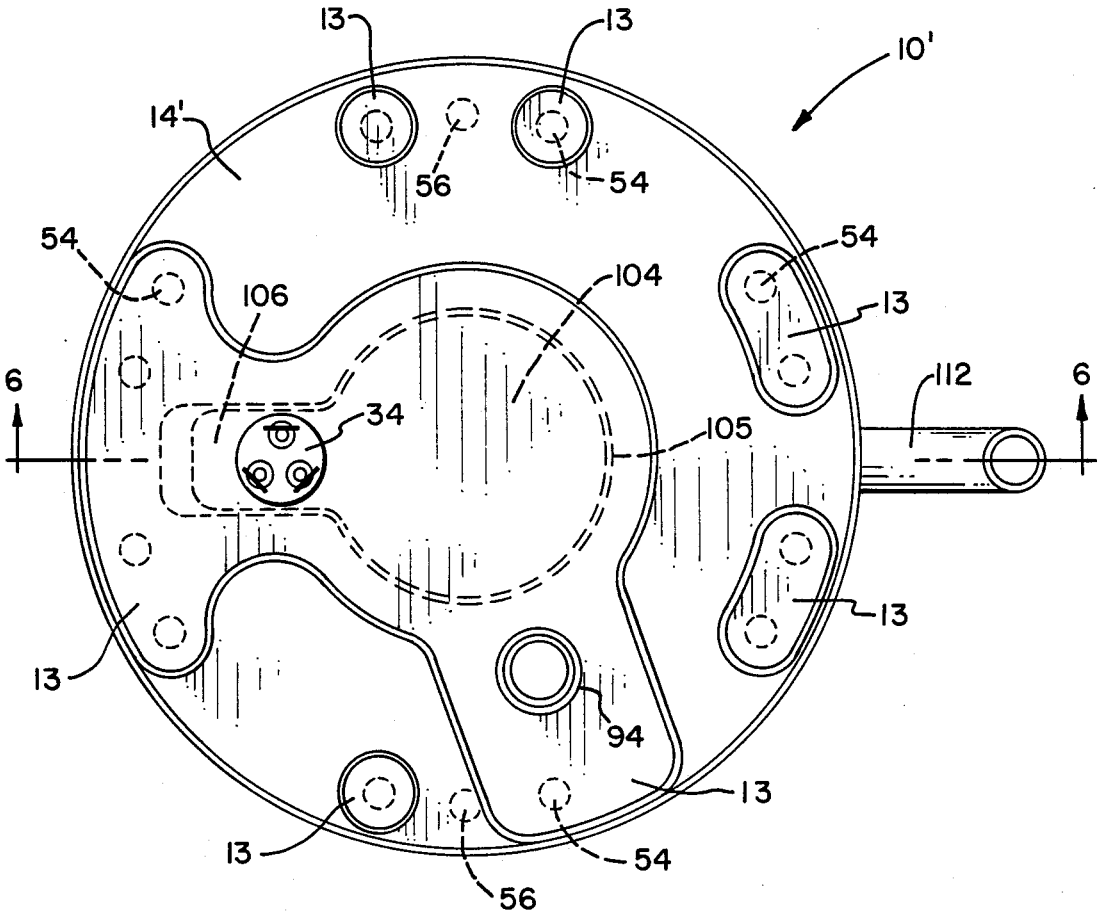
FIG. 7 is an enlarged top view of the compressor of FIG. 6.
Figure 6:
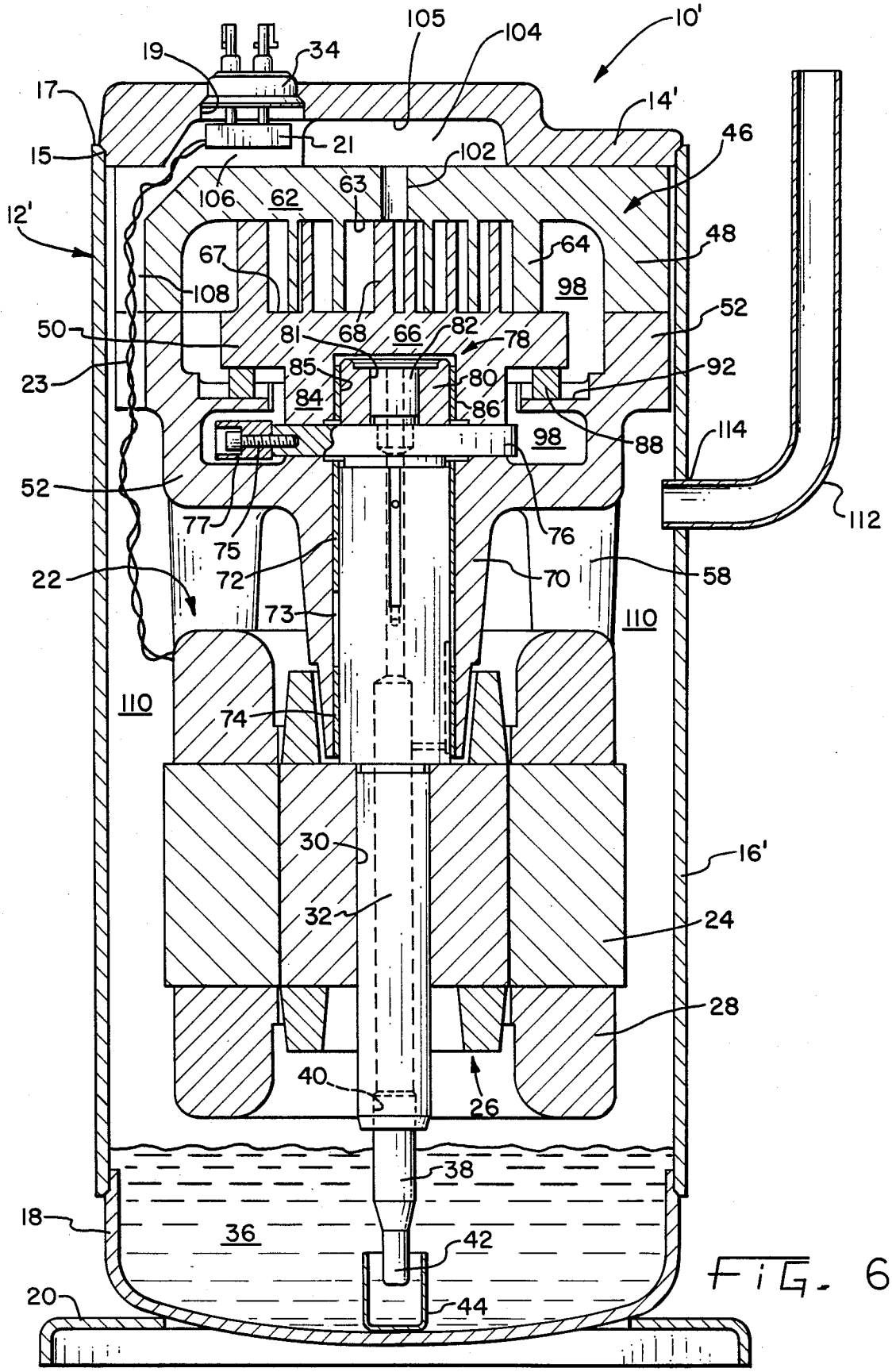
FIG. 6 is a longitudinal sectional view of a scroll-type compressor similar to the compressor of FIG. 1, taken along the line 6—6 in FIG. 7 and viewed in the direction of the arrows, according to an alternative embodiment of the present invention wherein the terminal cluster is attached to the top cover plate, the reference numerals used in FIGS. 6 and 7 being identical to those used in FIGS. 1-5 in the case of identical components, and being primed in those instances where a component has been modified in accordance with the alternative embodiment.

Reference will now be made to FIGS. 6 and 7 for an alternative embodiment of the present invention. Specifically, terminal cluster 34 is mounted within a recess 19 in top cover plate 14', rather than in central portion 16'. A wiring harness including an electrical connector 21 and wiring 23 attaches to the terminal pins of terminal cluster 34 and provides a conductive path for electric current to stator 24 of motor 22. Terminal cluster 34 and associated connector 21 are conveniently located within radially extending duct 106, whereby wiring 23 extends through duct 106 and axially extending duct 108 before entering housing chamber 110, where it connects to windings 28 of stator 24. The alternative embodiment of FIGS. 6 and 7 has special significance to the method of assembling a compressor in accordance with one aspect of the present invention, which will now be described.

A method of assembling a scroll compressor in accordance with one aspect of the present invention involves top cover plate 14 and the resulting structure described herein. Specifically, cover plate 14 allows compressor mechanism 46 to be completely assembled and attached to cover plate 14 prior to being inserted into the housing interior and the cover plate being attached to the remaining housing shell. In the preferred method of assembling compressor 10, wherein cover plate 14 is provided, compressor mechanism 46 is mounted to cover plate 14 as previously described, such that face plate 62 is adjacent cover plate 14. When mounted to cover plate 14, compressor mechanism 46 may be already completely assembled, including setting of the air gap between stator 24 and rotor 26.

Next, a vertically upstanding shell having a top opening is provided, wherein the shell comprises central portion 16 and bottom portion 18, as shown in the drawings, or is alternatively of one-piece construction. Lastly, the top cover plate and compressor mechanism assembly is attached to the remainder of the housing such that top cover plate 14 covers to top opening of the housing shell and is sealingly thereto, and compressor mechanism 46 extends downwardly into the interior of the housing. When attaching cover plate 14 to central portion 16, care is taken so that compressor mechanism 46 is suspended from top cover plate 14 and does not contact any other portion of housing 12, thereby preventing noise transmission from the compressor mechanism to the housing.

The aforementioned method of assembly varies slightly with respect to the embodiment of FIGS. 1–5 and the embodiment of FIGS. 6 and 7. When assembling the compressor of FIGS. 1–5, connector 21 of the wiring harness of stator 24 must be connected to terminal cluster 34, located in central portion 16, at a time during insertion of the compressor mechanism into the housing when the length of wiring 23 permits such connection. In contrast, assembly of the compressor of FIGS. 6 and 7 allows connection of connector 21 to terminal cluster 34, located in top cover plate 14', at a time prior to insertion of the compressor mechanism into the housing. Not only is the method of assembling the compressor of FIGS. 6 and 7 made easier by the location of the terminal cluster in the top cover plate, but the compressor mechanism is capable of being connected to a source of electric power for easy testing prior to final assembly.

It will be appreciated that the foregoing description of various embodiments of the invention is presented by way of illustration only and not by way of any limitation, and that various alternatives and modifications may be made to the illustrated embodiments without departing from the spirit and scope of the invention.

What is claimed is:

1. A scroll compressor for compressing refrigerant fluid comprising:

a fixed scroll member including a plate portion having a face surface and a back surface, said face surface having an involute fixed wrap element thereon;

an orbiting scroll member including an involute orbiting wrap element, said fixed and orbiting wrap elements being intermeshed to define at least one pocket of refrigerant fluid compressed by orbiting motion of said orbiting scroll member with respect to said fixed scroll member; and plate means, fixedly attached to said fixed scroll member adjacent the entire said back surface, for exposing a predetermined partial area of said back surface to compressed refrigerant fluid, said plate means comprising a plate member having an abutting surface adjacent said fixed scroll member back surface, said predetermined partial area being spaced from said abutting surface.

2. The scroll compressor of claim 1 in which:

said abutting surface includes a centrally located recessed area that together with said back surface defines a discharge chamber for compressed refrigerant fluid.

3. The scroll compressor of claim 2 in which:

said fixed scroll member plate portion includes a discharge port extending therethrough, said discharge port providing fluid communication between said pocket of compressed refrigerant fluid and said discharge chamber.

4. The scroll compressor of claim 2, and further comprising:

a vertically upstanding shell having a top opening, said plate member covering said top opening and being sealingly attached to said shell such that said shell and said plate member comprise a hermetically sealed housing having an interior space; and muffling means for conveying refrigerant fluid from said pocket of compressed refrigerant fluid through said discharge chamber into said interior space.

5. The scroll compressor of claim 4 in which:

said muffling means comprises a discharge port extending through said plate portion to provide fluid communication between said pocket of compressed refrigerant fluid and said discharge chamber.

6. The scroll compressor of claim 4 in which:

said muffling means comprises a radially extending duct defined by said abutting surface and said back surface, said duct providing fluid communication between said discharge chamber and said interior space.

7. The scroll compressor of claim 1, and further comprising:

a vertically upstanding shell having a top opening, said plate means comprising a top cover plate covering said top opening and being sealingly attached to said shell such that said shell and said cover plate comprise a hermetically sealed housing.

8. The scroll compressor of claim 1, wherein said plate means comprises a plate member, and further comprising:

suction inlet means for supplying refrigerant fluid to said pocket for compression by said orbiting motion of said orbiting scroll member, said suction inlet means comprising a suction passageway extending through said plate member and said fixed scroll member plate portion.

9. A scroll compressor for compressing refrigerant fluid, comprising:

a fixed scroll member including a plate portion having a face surface and a back surface, said face surface having an involute fixed wrap element thereon; said plate portion including a discharge port extending therethrough to provide fluid communication between a radially inner portion of said fixed wrap element and said back surface;

an orbiting scroll member including an involute orbiting wrap element, said fixed and orbiting wrap elements being intermeshed to define at least one pocket of refrigerant fluid compressed radially inwardly toward said discharge port by orbiting motion of said orbiting scroll member with respect to said fixed scroll member; and a plate member fixedly attached to said fixed scroll member adjacent the entire said back surface, said plate member and a predetermined area of said back surface defining a discharge chamber, said discharge chamber being in fluid communication with said discharge port, whereby said partial area of said back surface is exposed to compressed refrigerant fluid.

10. The scroll compressor of claim 9 and further comprising:

a vertically upstanding shell having a top opening, said plate member covering said top opening and being sealingly attached to said shell such that said shell and said plate member comprise a hermetically sealed housing.

11. The scroll compressor of claim 10, wherein said housing includes an interior space at discharge pressure, and further comprising:

muffling means for conveying refrigerant fluid from said pocket of compressed refrigerant fluid through said discharge chamber into said interior space.

12. The scroll compressor of claim 9, and further comprising:

a vertically upstanding shell having a top opening, said plate member covering said top opening and being sealingly attached to said shell such that said shell and said plate member comprise a hermetically sealed housing; and suction inlet means for supplying refrigerant fluid to said pocket for compression by said orbiting motion of said orbiting scroll member, said suction inlet means comprising a suction passageway extending through said plate member and said fixed scroll member plate portion.

13. A hermetically sealed scroll compressor for compressing refrigerant fluid, comprising:

a vertically upstanding shell having a top opening;

a top cover plate covering said top opening and being sealingly attached to said shell such that said shell and said cover plate comprise a hermetically sealed housing having an interior space, said cover plate including an abutting surface facing the interior of said housing; and a scroll compressor mechanism comprising a fixed scroll member including a plate portion having a back surface, an orbiting scroll member, and drive means for causing said orbiting scroll member to orbit with respect to said fixed scroll member to compress refrigerant fluid, said fixed scroll member being fixedly attached to said cover plate with the entire said back surface of said fixed scroll member adjacent said abutting surface of said cover plate, whereby said compressor mechanism is attached to said top cover plate and extends downwardly into said interior space.

14. The scroll compressor of claim 13, wherein said drive means comprises an electric motor, and further comprising:

conductive means, including an electric terminal attached to said top cover plate, for providing a conductive path for electric current to flow from outside said housing to said electric motor.

15. The scroll compressor of claim 14 in which:

said conductive means includes an electrical conductor length having one end connected to said motor, the other end of said conductor length having an electrical connector connectable to said terminal.

16. The scroll compressor of claim 13, wherein said drive means comprises an electric motor, and further comprising:

an electric terminal providing a conductive path between the outside of said housing to the interior thereof for delivery of electric current to said electric motor;

suction inlet means for supplying refrigerant fluid from outside said housing to said compressor mechanism; and discharge outlet means for delivering compressed refrigerant fluid from said compressor mechanism to outside said housing.

17. The scroll compressor of claim 16 in which:

said electric terminal is mounted to said top plate;

said suction inlet means includes a suction passageway through said top cover plate; and said discharge outlet means comprises a discharge tube extending through said shell to provide fluid communication between said interior space and the outside of said housing.

18. In a scroll compressor apparatus including a scroll compressor mechanism within a hermetically sealed housing, wherein said compressor mechanism comprises a fixed scroll member including a plate portion having a back surface, a method of assembling said scroll compressor apparatus, comprising the steps of:

providing a top cover plate having an abutting surface;

fixedly attaching said compressor mechanism to said top cover plate such that the entire said back surface of said fixed scroll member is adjacent said abutting surface of said cover plate;

providing a vertically upstanding shell having a top opening; and attaching said cover plate to said shell such that said cover plate sealingly covers said top opening and said compressor mechanism extends downwardly into said shell.

19. The method of assembling a scroll compressor of claim 18, wherein said compressor mechanism includes an electric motor, in which:

said top cover plate has an electric terminal attached thereto, and said step of mounting said compressor mechanism to said top cover plate includes electrically connecting said electric motor to said electric terminal.

20. The method of assembling a scroll compressor of claim 18 in which;

said step of attaching said cover plate to said shell is performed such that said compressor mechanism is in spaced relationship with said shell.

* * * * *